US006050301A

United States Patent [19]

Yoshida et al.

[11] Patent Number: 6,050,301

[45] Date of Patent: Apr. 18, 2000

[54] AL ALLOY COMPOSITE TUBE FOR REFRIGERANT PASSAGES AND METHOD FOR PRODUCING THE SAME

[75] Inventors: Akinori Yoshida; Yoshinori Kondo, both of Tokyo; Seiichi Kato, Kariya; Tetsuya Yamamoto, Kariya; Tsuguharu Shimpo, Kariya, all of Japan

[73] Assignees: The Furukawa Electric Co., Ltd., Tokyo; Denso Corporation, Aichi-ken, both of Japan

[21] Appl. No.: 09/120,456

[22] Filed: Jul. 23, 1998

[30] Foreign Application Priority Data

Jul. 23, 1997 [JP] Japan ..... 9-212613

[51] Int. Cl.[7] ..... F16L 9/14

[52] U.S. Cl. ..... 138/143; 138/142; 138/171; 138/177

[58] Field of Search ..... 138/141, 143, 138/142, 145, 114, 171, 177

[56] References Cited

U.S. PATENT DOCUMENTS

| | | | |
|---|---|---|---|
| 4,346,739 | 8/1982 | Asada | 138/143 |
| 4,495,003 | 1/1985 | Kubo | 138/143 X |
| 5,265,793 | 11/1993 | Usui et al. | 138/143 X |
| 5,565,277 | 10/1996 | Cox, Jr. et al. | 138/143 X |
| 5,887,628 | 3/1999 | Usui | 138/143 X |

FOREIGN PATENT DOCUMENTS

| | | |
|---|---|---|
| 1570184 | 6/1969 | France . |
| 50-34437 | 7/1948 | Japan . |
| 58-167089 | 10/1983 | Japan . |
| 61-192417 | 8/1986 | Japan . |
| 61-202720 | 9/1986 | Japan . |
| 63-97309 | 4/1988 | Japan . |
| 3-23012 | 1/1991 | Japan . |
| 8-281323 | 10/1996 | Japan . |

*Primary Examiner*—Patrick Brinson

[57] ABSTRACT

There is disclosed an Al alloy composite tube for refrigerant passages, made by extruding, or extruding and drawing a two-layer composite pipe obtained by shrink-fit of a tubular Al alloy inner material to the inside of a tubular Al alloy core, or a three-layer composite pipe obtained by shrink-fit of the two-layer composite pipe to the inside of a tubular Al alloy outer material; and a method for producing the same. This Al alloy composite tube for refrigerant passages causes less blisters at the interface between an inner pipe and an outer pipe, and can prevent debonding of the inner pipe.

14 Claims, 2 Drawing Sheets

AL ALLOY COMPOSITE TUBE FOR REFRIGERANT PASSAGES AND METHOD FOR PRODUCING THE SAME

FIELD OF THE INVENTION

The present invention relates to a composite tube made of Al alloys (hereinafter referred to as made of aluminum) for refrigerant passages that is excellent in corrosion resistance and brazability. The present invention also relates to a method for producing said composite tube.

BACKGROUND OF THE INVENTION

The inner surface of a tube made of aluminum that constitutes refrigerant passages of a heat exchanger for automobiles is required to be highly corrosion-resistant, because the inner surface is always in contact with a refrigerant. For this reason, the inner surface of the tube is lined, for example, with a corrosion-resistant material or a sacrificial material.

Specifically, an example of the lined tube is one in which the inside of a core for tubes made of high-strength JIS-3003 alloy (Al/0.15 wt. % Cu/1.1 wt. % Mn) or the like is lined with JIS-7072 alloy (Al/1 wt. % Zn) material, which latter is excellent in corrosion resistance.

The thickness of these conventional tubes of aluminum used for heat exchangers for automobiles is on the order of 1 to 2 mm, and these tubes are produced by preparing a clad pipe using a composite hollow billet by extruding and drawing the clad pipe into a tube.

In recent heat exchangers for automobiles, the wall of the tubes tends to be made thin, as the heat exchangers are made light in weight and the cost of the heat exchangers is lowered. As the method for producing these tubes that are required to have a thinner wall, as well as being required to be corrosion resistant and plastically workable, the use of clad tubes by the extrusion production method is useful.

In the extrusion production method, however, air is apt to be retained between the skin material and the core, and between the core and the lining material, and hence blisters (defects caused by air which was involved into the interface of the clad billet during its preparation and was expanded during extrusion and subsequent working and heating processes to cause the clad billet surface to blister.), defective joining, debonding of the inner pipe, and the like are apt to occur. These defects hardly cause problems in regard to the function in the case of conventional thick-wall tubes, whereas all of these defects are problems in the case of thin-wall tubes. For example, defective joining of an outer pipe may cause cracking in the drawing step and cracking in the duration of the post-working of the pipe of the heat exchanger parts, and debonding of an inner pipe leads to debonding of the lining material as the sacrificial material, and as a result the core is exposed there and will become corroded, to form through-holes. Furthermore, there is a problem that such debonding of an inner pipe for an elongate extruded material and an elongate coil produced by drawing a coil is hard to inspect before delivery.

As one means for preventing those problems, for example, a method is known in which a two-layer billet having a core and a lining material is cast previously in a casting stage, but the cost of the production is high and the method is technically difficult. Further, as a method wherein billets combined at low temperatures are used, there is a method in which the outer diameter of an inner billet is increased by moving forward a mandrel during the extrusion, to bring it in close contact with a core (JP-A-3-23012 ("JP-A" means unexamined published Japanese patent application)), but this method does not result in a satisfactory effect for thin-wall tubes.

SUMMARY OF THE INVENTION

In view of these circumstances, the present invention has been made as a result of intensive investigation. An object of the present invention is to provide a composite tube made of aluminum for refrigerant passages, by which tube the occurrence of blisters at the interface between an inner pipe and an outer pipe is less, and defective joining of the pipes, debonding of the inner pipe, and the like are prevented. Another object of the present invention is to provide a method for production of the said tube.

Other and further objects, features, and advantages of the invention will appear more fully from the following description, taken in connection with the accompanying drawings.

BRIEF DESCRIPTION OF THE DRAWINGS

FIG. 1A is a front view, and FIG. 1B is a side sectional view.

FIG. 2A is a front view, and FIG. 2B is a side sectional view.

DETAILED DESCRIPTION OF THE INVENTION

Figure 1A:
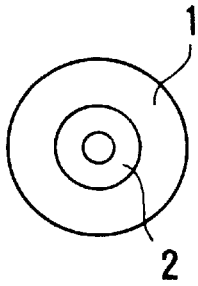
FIG. 1A and FIG. 1B show the state of shrink-fit of hollow billets according to the present invention.

One composite tube of the present invention is an Al alloy composite tube for refrigerant passages having a wall thickness of 0.8 mm or less, made by extruding, or extruding and drawing a two-layer composite pipe obtained by shrink-fit of a tubular Al alloy inner material to the inside of a tubular Al alloy core, or a three-layer composite pipe obtained by shrink-fit of the two-layer composite pipe to the inside of a tubular Al alloy outer material.

Another composite tube of the present invention is an Al alloy composite tube for refrigerant passage having a wall thickness of 0.8 mm or less (the lower limit of the thickness if not particularly limited, but it is generally 0.2 mm or more), made by extruding, or extruding and drawing a two-layer composite hollow billet obtained by shrink-fitting a tubular Al alloy inner material hollow billet to the inside of a heated tubular Al alloy core hollow billet by heating the tubular Al alloy core hollow billet to 350 to 600° C., or a three-layer composite hollow billet obtained by shrink-fitting the two-layer composite hollow billet to the inside of a heated tubular Al alloy outer material hollow billet by heating the tubular Al alloy outer material hollow billet to 350 to 600° C.

The above composite tubes of the present invention can be used as refrigerant passage members of Al alloy heat exchangers.

Further, the production method of the present invention is a method for producing a composite tube for refrigerant passages of Al alloy heat exchangers, having an Al alloy inner material layer formed on the inner circumferential surface of an Al alloy core layer, or further having an Al alloy outer material layer formed on the outer circumferential surface of the Al alloy core layer, which comprises forming a two-layer composite hollow billet by shrink-fitting a tubular Al alloy inner material hollow billet to a tubular Al alloy core hollow billet, or forming a three-layer composite hollow billet by further shrink-fitting the two-layer composite hollow billet to a tubular Al alloy outer material hollow billet, and hot-extruding, or hot-extruding and drawing the composite hollow billet. Preferably, in the shrink-fitting, the hollow billet positioned outside is heated to 350 to 600° C., the shrink-fit clearance [(the outer diameter of the inner material hollow billet at normal temperature)—(the inner diameter of the core hollow billet at normal temperature)] is 0.4 mm or more (the upper limit of the shrink-fit clearance is determined based on the relationship between the temperatures and the coefficient of thermal expansion, but it is generally 1.4 mm or less, and preferably 1.0 mm or less), and the insertion clearance [(the inner diameter of the core hollow billet when heated)—(the outer diameter of the inner material hollow billet at normal temperature)] is 0.8 mm or more (the upper limit of the insertion clearance is determined based on the relationship between the temperatures and the coefficient of thermal expansion, but it is generally 1.8 mm or less, and preferably 1.5 mm or less). In the shrink-fitting, it is effective if the heating of the hollow billet is carried out in (simultaneously with) the homogenizing process step of the hollow billet or the preliminary heating process step at the time of the hot extrusion, and it is also possible that a shrink-fitting process step is added to between the homogenizing process and the preliminary heating process. Further, the obtained composite tube has preferably a wall thickness of 0.8 mm or less. There is not particularly a lower limit to the wall thickness, but generally the lower limit is 0.2 mm or more.

Hereinbelow the present invention is described in detail.

In the composite tube made of aluminum obtained by the present invention, as the inner material and/or the outer material of the core, for example, one having a sacrificial material and a filler alloy formed in a layered manner, to improve the corrosion resistance of the tube and/or to make brazing of the tube possible, is used.

Therefore, in the present invention, as the aluminum alloy, any aluminum alloy can be used that can be hot-extruded or hot-extruded and drawn into a tube. Out of aluminum alloys, an Al-Mn-series alloy, represented by JIS-3003 alloy, and a pure aluminum-series alloy, represented by JIS-1100 alloy (Al/0.1 wt. % Cu) and JIS-1050 alloy (Al: 99.50 wt. % or more), which are excellent in workability, are particularly desirable as the core; an Al-Zn-series alloy, represented by JIS-7072 alloy, is desirable as the sacrificial material; and an Al-Si-series alloy, represented by JIS-4043 alloy (Al/5 wt. % Si), is desirable as the filler alloy.

Specifically, as the inner material of the core, for example, JIS-7072 alloy, JIS-4343 alloy (Al/7.5 wt. % Si), an alloy made by adding about 1 wt. % of Zn to JIS-4343 alloy, and JIS-4045 alloy (Al/10 wt. % Si) are used, and as the outer material, in addition to the above alloys, for example, JIS-1050 alloy and JIS-1070 alloy (Al: 99.70 wt. % or more) are used.

An example of preferable modes of the composite tubes of the present invention is, in the case of the two-layer composite tube, a combination can be mentioned in which the core is made of 3003 alloy, and its inner material is a sacrificial material of 7072 alloy. Preferably its cladding ratio is such that the cladding ratio of the sacrificial material is generally 2 to 20%, and preferably 5 to 15%, based on the thickness of the core.

Further, in the present invention, as a preferable mode of the three-layer composite tube, a combination in which the core is made of 3003 alloy, its inner material is a sacrificial material of 7072 alloy, and its outer material is a filler alloy material of 4045 alloy. Preferably, their cladding ratio is such that the cladding ratio of the sacrificial material is generally 2 to 20%, and preferably 5 to 15%, and the cladding ratio of the filler alloy is generally 2 to 20%, and preferably 3 to 7%, based on the thickness of the core.

In the present invention, for the core hollow billet of an aluminum alloy, for example, one obtained by boring an aluminum alloy solid billet, and one obtained by drilling a cast hollow billet, are used, and desirably the inner circumferential surface is finished by machining or the like.

For the inner material hollow billet used for the lining of the core and the outer material hollow billet to be formed on the outside of that core, for example, a pipe formed by extrusion, or extrusion and drawing, and a cylinder formed by cutting a cast billet, are used. Desirably, the outer circumferential surface, in the case of the inner material hollow billet, and the inner circumferential surface, in the case of the outer material hollow billet, are finished by extruding, drawing, machining, or the like.

In the present invention, since the two-layer composite hollow billet obtained by shrink-fitting the hollow billet and the inner material hollow billet, and the three-layer composite hollow billet obtained by shrink-fitting the two-layer composite hollow billet to the outer material hollow billet, are hot-extruded, for example, the sacrificial material and the filler alloy layer are joined to the inner surface or the outer surface of the core metallographically.

For the shrink-fitting of these, desirably, heating at the time of homogenizing or hot-extruding the billet is used, because heating cost can be saved and productivity is not impaired.

Preferably the heating temperature of the billet in the shrink-fitting is 350 to 600° C. If the heating temperature is too low, the shrink-fit clearance is less than 0.4 mm and the insertion clearance is less than 0.8 mm, which sometimes leads to a case in which a good shrink fit state is not obtained. Further, if an outer billet having an inner diameter equal to or a little larger than the outer diameter of the inner billet is used, and they are combined by heating, although the workability at the time of insertion is improved, the effect of the present invention cannot be obtained, because there is no shrink-fit effect. Although the upper limit of the heating temperature varies depending on the type of billet to be combined, from a practical point of view, preferably the upper limit of the heating temperature is 600° C., taking the melting point of the aluminum alloys into consideration.

The expansion coefficient of the core or the outer material at the time of expansion by heating (at the time of shrink-fitting) is not particularly restricted, but it is preferably on the order of 1.2%.

Figure 3:
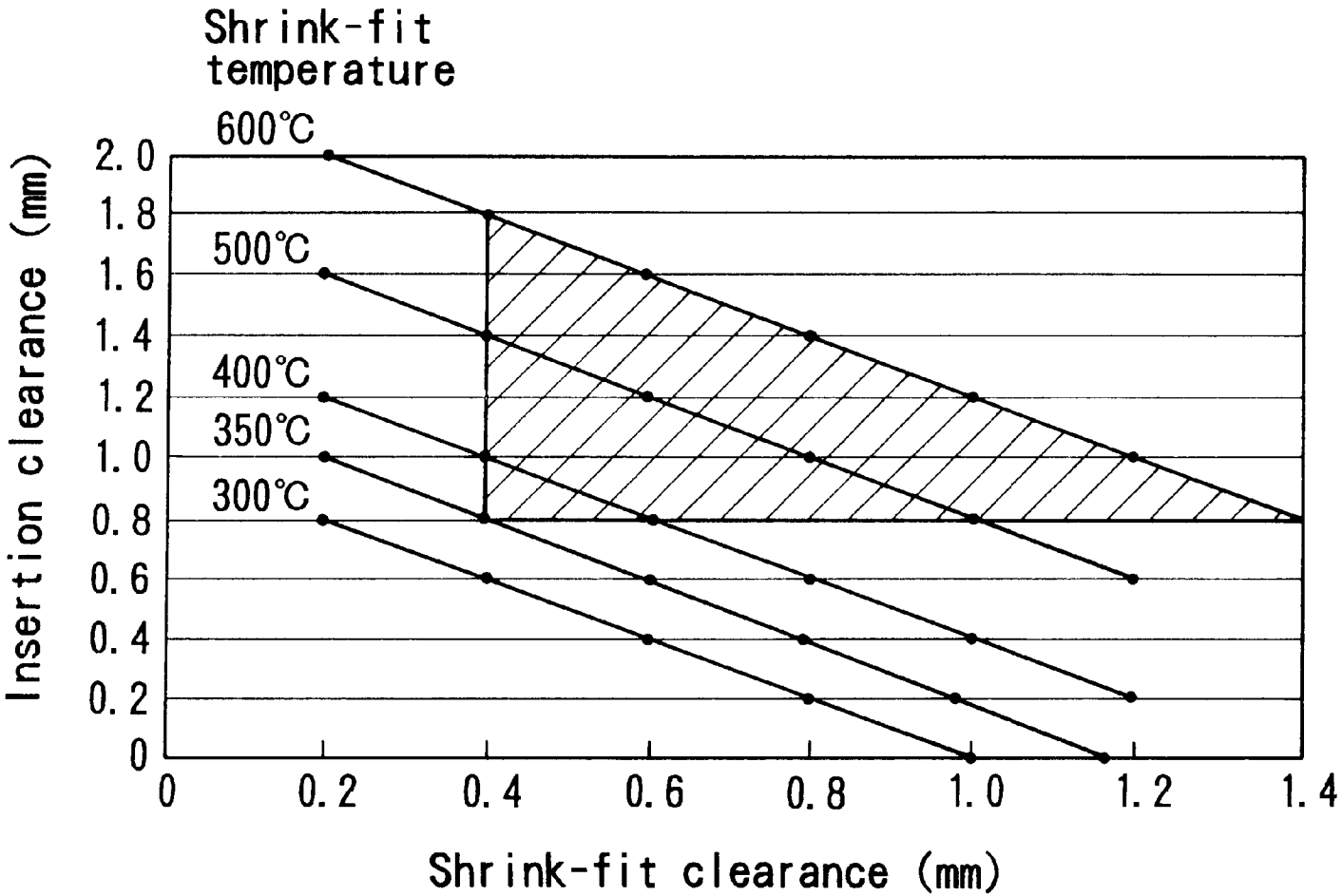
FIG. 3 is a correlation chart showing the relationship between the shrink-fit clearance (the allowance to shrink-fit) and the insertion clearance (the allowance to insert) by using the hollow billets of Example 1.

FIG. 3 illustrates preferable ranges of the shrink-fit clearance and the insertion clearance in accordance with the shrink-fit temperature. In FIG. 3, the range in the hatched right triangle is a preferable range where the shrink-fit clearance is 0.4 to 1.4 mm, the insertion clearance is 0.8 to 1.8 mm, and the shrink-fit temperature is 350 to 600° C. If the shrink-fit clearance is too small, a satisfactory shrink-fit effect cannot be secured, in some cases. If the insertion clearance is too small, the insertion operation cannot be carried out favorably, in some cases. The upper limit values of the shrink-fit clearance and the insertion clearance are values obtained from the relationship between the respective shrink-fit temperatures and the coefficient of thermal expansion.

The two-layer or three-layer composite hollow billet of aluminum alloys composited by the shrink-fitting is hot-extruded in a usual manner. The extrusion may be direct extrusion or indirect extrusion. The composite tube for aluminum heat exchangers of the present invention may be produced only by hot extrusion, or by hot extrusion and then drawing. Since the actual tube for heat exchangers is small in size, after the extrusion, drawing is carried out, in many cases. As the drawing, conventional drawing in which, for example, intermediate annealing is carried out in the processing, can be used.

In an application wherein formability is required, after the drawing, final annealing is made for the refining, to obtain an O-material or the like.

In the present invention, since the aluminum composite tube for refrigerant passages is produced by shrink-fitting a hollow billet to the inner circumferential side and/or the outer circumferential side of a core hollow billet of an aluminum alloy, followed by hot-extrusion, or by hot-extrusion and drawing, a composite tube for refrigerant passages can be obtained, by which tube the number of blisters at the interface between the layers is few; defective joining between the layers, debonding between the layers, and the like are prevented, and the workability is excellent. Further, by using a sacrificial material hollow billet on the inner circumferential side and a filler alloy hollow billet on the outer circumferential side, a composite tube for refrigerant passages of the present invention that is excellent in both corrosion-resistance and brazability can be obtained. Further, since the composite tube can be made thin-walled, the use of the composite tube for heat exchangers is effective in making the heat exchangers light in weight, and therefore heat exchangers that are thin-walled and light in weight can be produced by using the composite tube.

Next, the present invention is described in more detail with reference to Examples, which do not restrict the present invention.

EXAMPLES

Example 1

The inner surface of a cylindrical hollow billet of JIS-3003 alloy (having an outer diameter of 400 mm, an inner diameter of 80 mm, and a length of 1,000 mm) was drilled to obtain a core hollow billet having an inner diameter of 148 mmϕ at normal temperatures (20° C.), and an extruded pipe of JIS-7072 alloy (having an outer diameter of 148.8 mm, an inner diameter of 80 mm, and a length of 990 mm at normal temperatures) was obtained as a lining material hollow billet.

Figure 1B:
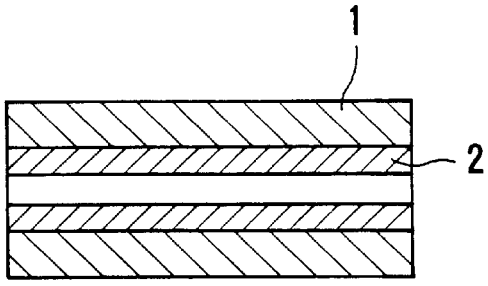

Then, as is shown in FIG. 1, after heating the core hollow billet (1) to 500° C., the lining material hollow billet (2) at normal temperatures was inserted into the inner hollow part of the core hollow billet (1), followed by cooling, to effect shrink-fitting.

The thus-obtained shrink-fitted two-layer composite hollow billet was extruded indirectly at 450° C. into an extruded pipe having an outer diameter of 47 mm and a wall thickness of 3.5 mm, and then the extruded pipe was drawn repeatedly, to produce composite tubes for refrigerant passages having an outer diameter of 10 mm and wall thicknesses of 1 mm, 0.7 mm, 0.5 mm, and 0.3 mm, respectively. The cladding ratio of the lining material to the core in each of the thus-prepared composite tubes was adjusted to 10.5% by the drawing processing. Further they were finally annealed for the refining for O-material.

Conventional Example 1

Figure 2A:
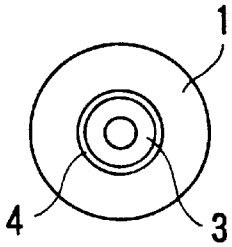
FIG. 2A and FIG. 2B show the combined state of hollow billets according to the conventional technique.
Figure 2B:
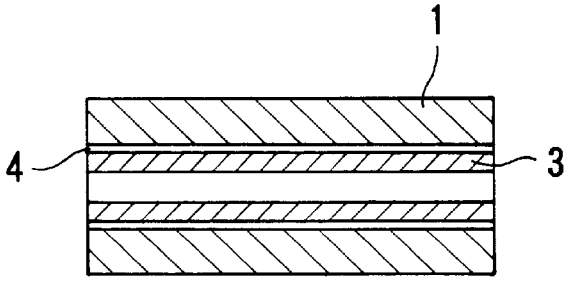

As is shown in FIG. 2, the outer diameter of an extruded pipe (3) of JIS-7072 alloy was made to be 145 mmϕ, it was inserted into the inner hollow part of a core hollow billet (1) that was the same as the above billet (1) in Example 1 with a gap (4) formed at normal temperatures, and thereafter in the same manner as in Example 1, a composite tube was produced.

The obtained tubes were cut into lengths of 500 mm, and out of them, 100 tubes (corresponding to 50 m) were taken randomly and were cut open longitudinally, to determine the number of defects, such as blisters, in the inner surfaces.

The workability of the tubes was investigated by the tube enlargement test. The results thereof are shown in Table 1.

TABLE 1

| Composite tube | Example 1 (This invention) | | Conventional Example 1 | |
|---|---|---|---|---|
| size (outer diameter: ϕ 10) | Inner surface observation result | Tube enlargement test result | Inner surface observation result | Tube enlargement test result |
| Wall thickness: 1.0 mm | defects: 0/50 m | no cracks | defects: 45/50 m | no cracks |
| Wall thickness: 0.7 mm | defects: 0/50 m | no cracks | defects: 71/50 m | some cracks |
| Wall thickness: 0.5 mm | defects: 0/50 m | no cracks | defects: 56/50 m | many cracks |
| Wall thickness: 0.3 mm | defects: 0/50 m | no cracks | defects: 95/50 m | many cracks |

Every example shown in Table 1 is 10.5% cladding ratio of the lining material to the core.

As is apparent from the results shown in Table 1, in the Example of this invention, there were no blisters and the like in the inner surfaces, and the workability was good.

In contrast, it was found that, in the Conventional Example, in which billets that were combined at normal (cold) temperatures were used, there occurred many defects in the inner surfaces, which caused cracking when the tubes having wall thicknesses of 0.7 mm or more were worked, and the thinner the wall thickness was, the more cracks were observed.

The outer diameter of a JIS-7072 alloy lining material hollow billet that was to be shrink-fitted to the above core hollow billet that was finished to have an inner diameter of 148 mmϕ was varied, so that the shrink-fit clearance [(the outer diameter of the lining material hollow billet at normal temperatures)—(the inner diameter (148 mm) of the core hollow billet at normal temperatures)] was made to be 0.2 to 1.4 mm, as shown in FIG. 3. The relationship between the heating temperature of the core hollow billet and the insertion clearance of the lining material hollow billets at the time of shrink-fitting was obtained. The results of various experiments found that the insertion clearance; that is, the clearance between the inner diameter and the outer diameter, that did not cause any trouble of insertion at the time of shrink-fitting, was required to be preferably 0.8 mm or more, and the effective shrink-fit clearance was required to be preferably 0.4 mm or more. Further, the addition of the shrink-fit temperature thereto shows that the region in the triangle hatched in the figure is the effective range.

Example 2

A two-layer composite hollow billet obtained by shrink-fitting a JIS-7072 alloy lining material hollow billet into the inside of a JIS-3003 alloy core hollow billet in the same manner as in Example 1, and a three-layer composite hollow billet obtained by shrink-fitting the two-layer composite hollow billet into the inside of a JIS-7072 alloy hollow billet, were hot-extruded into blank pipes having an outer diameter of 47 mmϕ and a wall thickness of 3.5 mm. Then, the blank pipes were drawn according to the schedule (Step A and Step B) shown in Table 2, with a working ratio of 25 to 45% per pass, to produce a two-layer composite tube and a three-layer composite tube having an outer diameter of 10.0 mm and wall thicknesses of 0.7 and 0.3 mm, respectively (Example of the present invention).

In place of the above combination of materials, a two-layer composite hollow billet obtained by shrink-fitting a JIS-4043 alloy lining material hollow billet into a JIS-3003 alloy core hollow billet, was hot-extruded into a blank pipe like the above. Then, the blank pipe was drawn according to the schedule of Step C shown in Table 2, with a working ratio of 25 to 45% per pass, to produce a two-layer composite tube having an outer diameter of 6.0 mm and a wall thickness of 0.3 mm (Example of the present invention).

The cladding ratios of the lining material and the outer material, to the core, in the thus-prepared composite tubes, were each 10.2%.

Hollow billets made of the same materials as above were combined without shrink-fitting and with a sufficient clearance at normal temperatures, as shown in FIG. 2, and they were extruded into blank pipes, as shown in Table 2, and the blank pipes were drawn according to the same pass schedule, as shown in Table 2, to produce composite tubes (Comparative Example).

TABLE 2

| Step | A | B | C |
|---|---|---|---|
| Blank pipe | Outer diameter (ϕ 47 mm) × wall thickness (t 3.5 mm) | | |
| Pass schedule | ϕ 39 × t 2.7 | ϕ 39 × t 2.7 | ϕ 39 × t 2.7 |
| | ↓ | ↓ | ↓ annealing |
| | ϕ 33 × t 2.4 | ϕ 32 × t 2.0 | ϕ 33 × t 2.2 |
| | ↓ | ↓ | ↓ |
| | ϕ 27 × t 2.0 | ϕ 27 × t 1.6 | ϕ 27 × t 1.9 |
| | ↓ | ↓ | ↓ annealing |
| | ϕ 23 × t 1.7 | ϕ 23 × t 1.2 | ϕ 22 × t 1.6 |
| | ↓ | ↓ | ↓ |
| | ϕ 19 × t 1.4 | ϕ 20 × t 1.0 | ϕ 18 × t 1.2 |
| | ↓ | ↓ | ↓ annealing |
| | ϕ 16 × t 1.1 | ϕ 18 × t 0.8 | ϕ 15 × t 0.9 |
| | ↓ | ↓ | ↓ |
| | ϕ 13 × t 0.9 | ϕ 15 × t 0.7 | ϕ 13 × t 0.7 |
| | ↓ | ↓ | ↓ annealing |
| | ϕ 10 × t 0.7 | ϕ 13 × t 0.5 | ϕ 11 × t 0.6 |
| | | ↓ | ↓ |
| | | ϕ 11 × t 0.4 | ϕ 9 × t 0.5 |
| | | ↓ | ↓ annealing |
| | | ϕ 10 × t 0.3 | ϕ 7 × t 0.4 |
| | | | ↓ |
| | | | ϕ 6 × t 0.3 |
| Example of the present invention (two- and three-layer tubes) | no cracks at ϕ 10 × t 0.7 | no cracks at ϕ 10 × t 0.3 | no cracks at ϕ 6 × t 0.3 |
| Comparative Example (two- and three-layer tubes) | cracked at ϕ 10 × t 0.7 | cracked at ϕ 18 × t 0.8 | cracked at ϕ 13 × t 0.7 |

Every example shown in Table 2 is 10.2% cladding ratios of the lining material and the outer material, if any, to the core, respectively.

It can be understood from the results shown in Table 2 that the two-layer composite tube and the three-layer composite tube of the Example of the present invention were not cracked, even when they were drawn to the final size, whereas tubes of Comparative Example, which were produced by using billets cold-combined without shrink-fitting, cracked when the wall thickness was 0.7 mm that was the final size in Step A, and when the wall thickness was 0.8 mm and 0.7 mm that were intermediate sizes in the course of drawing in Step B and Step C.

In passing, in the case of the production according to Step B, if the annealing is conducted, for example, when an outer diameter of 20 mmϕ and a wall thickness of 1.0 mm are obtained, the finishing can realize the final size with the number of steps decreased by one pass.

Having described our invention as related to the present embodiments, it is our intention that the invention not be limited by any of the details of the description, unless otherwise specified, but rather be construed broadly within its spirit and scope as set out in the accompanying claims.

What we claim is:

1. An Al alloy composite tube for refrigerant passages having a wall thickness of 0.8 mm or less, made by extruding a two-layer composite pipe obtained by shrink-fit of a tubular Al alloy inner material to the inside of a tubular Al alloy core.

2. An Al alloy composite tube for refrigerant passages having a wall thickness of 0.8 mm or less, made by extruding and drawing a two-layer composite pipe obtained by shrink-fit of a tubular Al alloy inner material to the inside of a tubular Al alloy core.

3. An Al alloy composite tube for refrigerant passages having a wall thickness of 0.8 mm or less, made by extruding a three-layer composite pipe obtained by shrink-fit of a two-layer composite pipe to the inside of a tubular Al alloy outer material, wherein the two-layer composite pipe is obtained by shrink-fit of a tubular Al alloy inner material to the inside of a tubular Al alloy core.

4. An Al alloy composite tube for refrigerant passages having a wall thickness of 0.8 mm or less, made by extruding and drawing a three-layer composite pipe obtained by shrink-fit of a two-layer composite pipe to the inside of a tubular Al alloy outer material, wherein the two-layer composite pipe is obtained by shrink-fit of a tubular Al alloy inner material to the inside of a tubular Al alloy core.

5. The Al alloy composite tube for refrigerant passages as claimed in claims 1 or 2–4, which is used as a refrigerant passage member of an Al alloy heat exchanger.

6. The Al alloy composite tube for refrigerant passages as claimed in claims 1 or 2–4, wherein the cladding ratio of the Al alloy inner material is 2 to 20%, to the thickness of the Al alloy core.

7. The Al alloy composite tube for refrigerant passages as claimed in claims 1 or 2–4, wherein the cladding ratio of the Al alloy inner material and the cladding ratio of the Al alloy outer material are 2 to 20% and 2 to 20%, respectively, to the thickness of the Al alloy core.

8. An Al alloy composite tube for refrigerant passage having a wall thickness of 0.8 mm or less, made by extruding a two-layer composite hollow billet obtained by shrink-fitting a tubular Al alloy inner material hollow billet to an inside of a heated tubular Al alloy core hollow billet by heating the tubular Al alloy core hollow billet to 350 to 600° C.

9. An Al alloy composite tube for refrigerant passage having a wall thickness of 0.8 mm or less, made by extruding and drawing a two-layer composite hollow billet obtained by shrink-fitting a tubular Al alloy inner material hollow billet to an inside of a heated tubular Al alloy core hollow billet by heating the tubular Al alloy core hollow billet to 350 to 600° C.

10. An Al alloy composite tube for refrigerant passage having a wall thickness of 0.8 mm or less, made by extruding a three-layer composite hollow billet obtained by shrink-fitting a two-layer composite hollow billet to the inside of a heated tubular Al alloy outer material hollow billet by heating the tubular Al alloy outer material hollow billet to 350 to 600° C., wherein the two-layer composite hollow billet is obtained by shrink-fitting a tubular Al alloy inner material hollow billet to an inside of a heated tubular Al alloy core hollow billet by heating the tubular Al alloy core hollow billet to 350 to 600° C.

11. An Al alloy composite tube for refrigerant passage having a wall thickness of 0.8 mm or less, made by extruding and drawing a three-layer composite hollow billet obtained by shrink-fitting a two-layer composite hollow billet to the inside of a heated tubular Al alloy outer material hollow billet by heating the tubular Al alloy outer material hollow billet to 350 to 600° C., wherein the two-layer composite hollow billet is obtained by shrink-fitting a tubular Al alloy inner material hollow billet to an inside of a heated tubular Al alloy core hollow billet by heating the tubular Al alloy core hollow billet to 350 to 60° C.

12. The Al alloy composite tube for refrigerant passages as claimed in claims 8 or 9–11, which is used as a refrigerant passage member of an Al alloy heat exchanger.

13. The Al alloy composite tube for refrigerant passages as claimed in claims 8 or 9–11, wherein the cladding ratio of the Al alloy inner material is 2 to 20%, to the thickness of the Al alloy core.

14. The Al alloy composite tube for refrigerant passages as claimed in claims 8 or 9–11, wherein the cladding ratio of the Al alloy inner material and the cladding ratio of the Al alloy outer material are 2 to 20% and 2 to 20%, respectively, to the thickness of the Al alloy core.

* * * * *